US006889403B2

(12) United States Patent
Inoue et al.

(10) Patent No.: US 6,889,403 B2
(45) Date of Patent: May 10, 2005

(54) CYCLONIC VACUUM CLEANER

(75) Inventors: Mineyuki Inoue, Niigata-ken (JP); Takeshi Yamada, Niigata-ken (JP); Shuichi Taniguchi, Niigata-ken (JP); Toshiaki Ogawa, Niigata-ken (JP)

(73) Assignee: Twinbird Corporation, Niigata-Ken (JP)

( * ) Notice: Subject to any disclaimer, the term of this patent is extended or adjusted under 35 U.S.C. 154(b) by 393 days.

(21) Appl. No.: 10/054,267

(22) Filed: Jan. 22, 2002

(65) Prior Publication Data

US 2002/0095741 A1 Jul. 25, 2002

(30) Foreign Application Priority Data

Jan. 22, 2001 (JP) ..... 2001-013827

(51) Int. Cl.[7] ..... A47L 9/16

(52) U.S. Cl. ..... 15/353; 15/347; 55/337; 55/429; 55/DIG. 3

(58) Field of Search ..... 15/347, 350, 351, 15/352, 353; 55/337, 429, DIG. 3

(56) References Cited

U.S. PATENT DOCUMENTS

| | | | | |
|---|---|---|---|---|
| 3,529,724 A | | 9/1970 | Maciula et al. | |
| 3,543,325 A | | 12/1970 | Hamrick | |
| 4,172,710 A | * | 10/1979 | van der Molen | 55/340 |
| 5,307,538 A | | 5/1994 | Rench et al. | |
| 6,070,291 A | | 6/2000 | Bair et al. | |
| 6,146,434 A | * | 11/2000 | Scalfani et al. | 55/334 |
| 6,171,356 B1 | | 1/2001 | Twerdun | |
| 6,558,453 B2 | * | 5/2003 | Sepke et al. | 95/268 |
| 6,647,587 B1 | * | 11/2003 | Ohara et al. | 15/350 |

FOREIGN PATENT DOCUMENTS

| | | |
|---|---|---|
| EP | 0 928 594 A1 | 7/1999 |
| GB | 2 344 278 A | 6/2000 |
| JP | 52-069861 | 6/1977 |
| JP | 56-040744 | 4/1981 |
| JP | P2000-135183 A | 5/2000 |
| JP | 2000-166829 | 6/2000 |

OTHER PUBLICATIONS

Notice of Reason For Rejection; English version of Japanese Application No. 2001–013827, Dec. 22, 2003.

* cited by examiner

*Primary Examiner*—Terrence R. Till
(74) *Attorney, Agent, or Firm*—Quarles & Brady LLP

(57) ABSTRACT

A cyclonic vacuum cleaner which suppresses the flow of dust-laden airflow to the outside of a dust collection container, even if fine or comparatively light dust particles ascend together with a vortex flow. Fine dust particles mixed in the vortex flow are captured by a filter 23 of a first vent hole 21 provided at a lower end of a base 19 of a vortex flow generating member 18. If the filter 23 is clogged with such particles to some extent, yet the airflow inside a dust collection container 15 is allowed to pass through a second vent hole 22 formed on the side surface of the base 19 of the vortex flow generating member 18 into an intake hole 12. As a result, a constant amount of airflow is insured. Further, owing to a skirt portion 25 provided around the first vent hole 21, the travel of the dust particles toward the second vent hole 22 can be prevented even though the dust particles captured by the filter 23 are carried on the vortex flow toward the second vent hole 22.

14 Claims, 8 Drawing Sheets

CYCLONIC VACUUM CLEANER

BACKGROUND OF THE INVENTION a) Field of the Invention

The present invention relates to a vacuum cleaner with a cyclonic dust collection device, particularly to a structure of such dust collection device.

b) Prior Art

Conventional cyclonic cleaners of this type are disclosed for example in Japanese Un-Examined Patent Publication No. 2000-135183. The disclosed vacuum cleaner comprises: a cleaner body with an electric fan unit (a fan unit); a front end pipe (a vacuum pipe) including a floor suction nozzle (suction hole) at its tip end; a first air path defined by the floor suction nozzle and the front end pipe; a second air path defined by a joint pipe and a hose; and a cyclonic separation type dust collection device attached to between the first and the second air paths. Thus, an airflow is generated by actuating the electric fan unit so that dusts are sucked from the floor suction nozzle together with the airflow, thus generating a vortex flow along an inside surface of a cylindrical dust collecting portion (or dust collection container) that constructs the aforesaid cyclonic dust collection device. This vortex flow falls down toward a bottom plate of the cylindrical dust-collecting portion, while the dusts included in the vortex flow are allowed to whirl round along the inside surface thereof due to a centrifugal force, whereby the dusts are collected in a bottom portion by such centrifugal force and downwardly-directing force developed by the descending vortex flow. The vortex flow from which the dusts were removed thus way is then allowed to rise up from near the center of the bottom plate of the said cylindrical dust collection portion to thereby be discharged to the outside of the cyclonic separation type dust collection device from a vent hole formed at an end of a rear end pipe.

According to the conventional cyclonic vacuum cleaner, however, fine or comparatively light dusts also are allowed to ascend together with the vortex flow, which, in association with the fact that the vent hole of the rear end pipe is opposite to the bottom plate of the cylindrical dust collecting portion, are likely to be discharged from the vent hole to the outside of the cyclonic separation dust collection device. A known solution for such problem is to cover the vent hole with a meshed member such as a filter. In that case, however, such filter is liable to be clogged with loose dust and the like, thus lowering the vacuum efficiency of an electric fan unit.

SUMMARY OF THE INVENTION

To eliminate the above problems, it is a main object of the invention to provide a cyclonic vacuum cleaner which is less likely to discharge fine or comparatively light dusts to the outside of a dust collection container even though they are allowed to ascend together with a vortex airflow.

It is another object of the invention to provide a cyclonic vacuum cleaner whose vacuuming efficiency is less likely to be degraded.

To attain the above objects, there is provided from a first aspect of the invention, a cyclonic vacuum cleaner which comprises: a cleaner body with a fan unit; a vacuum tube having a suction hole at a distal end thereof; a dust collection container which is approximately cylinder-shaped, having a bottom; an attachment portion for detachably attaching said dust collection container, said attachment portion being mounted to the cleaner body or to the vacuum tube; a first air path extending from said suction hole to said attachment portion in a manner capable of communicating with said dust collection container; a second air path extending from said attachment portion to said fan unit, communicating with said dust collection container;

wherein a vortex flow generating member for generating a vortex flow inside said dust collection container is provided in an opening of said dust collection container, said vortex flow generating member comprising: a base which is formed into a shape of a short cylinder or a truncated short cone; an airflow guide provided on a side surface of said base; a first vent hole provided at an end of said base; a second vent hole provided at another side surface of said base; and a filter provided in each of said first and second vent holes.

According to the first aspect of the invention, when the fan unit is actuated, the dust-laden air sucked from the suction hole passes through the first air path into the dust collection container, where it is converted into the vortex flow by the airflow guide of the vortex flow generating member, so that the vortex flow thus generated is allowed to ascend within the dust collection container with the dust particles being separated therefrom, passing through the first and the second vent holes and the second air path into the fan unit. At that moment, even though fine or comparatively light particles are mixed in the vortex flow, such particles are captured by the filter provided in the first vent hole facing downwardly. If the filter is clogged with such particles to some extent, yet the airflow inside the dust collection container is allowed to pass through the second vent hole formed on the side surface of the base of the vortex flow generating member into the second air path, whereby a constant amount of airflow is insured.

Further, there is provided, from a second aspect of the invention, a cyclonic vacuum cleaner with the structure of the first aspect, wherein a skirt portion is provided around a periphery of said first vent hole.

According to the second aspect of the invention, the travel of the dust particles toward the second vent hole can be prevented even though the dust particles captured by the filter provided in the first vent hole are carried on the vortex flow toward the second vent hole.

BRIEF DESCRIPTION OF THE DRAWINGS

Other objects, features and advantages of the invention will be apparent to those skilled in the art from the following description of the preferred embodiments of the invention, wherein reference is made to the accompanying drawings, of which.

DESCRIPTION OF PREFERRED EMBODIMENTS

Figure 1:
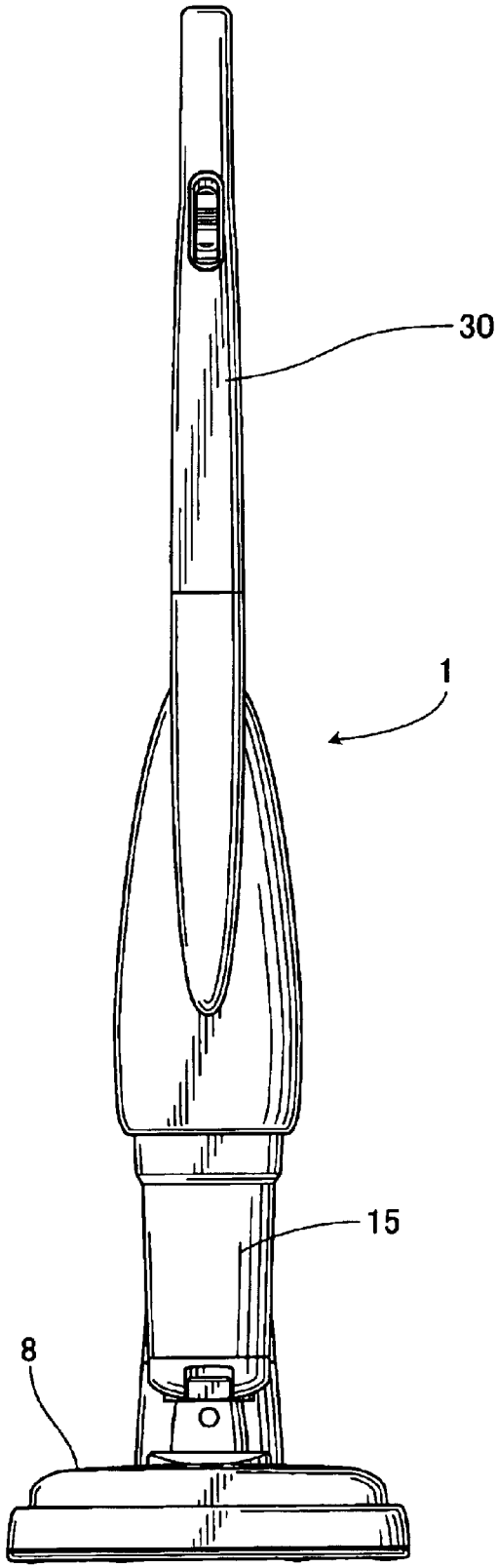
FIG. 1 is a front view of a cyclonic vacuum cleaner according to an embodiment of the invention.
Figure 2:
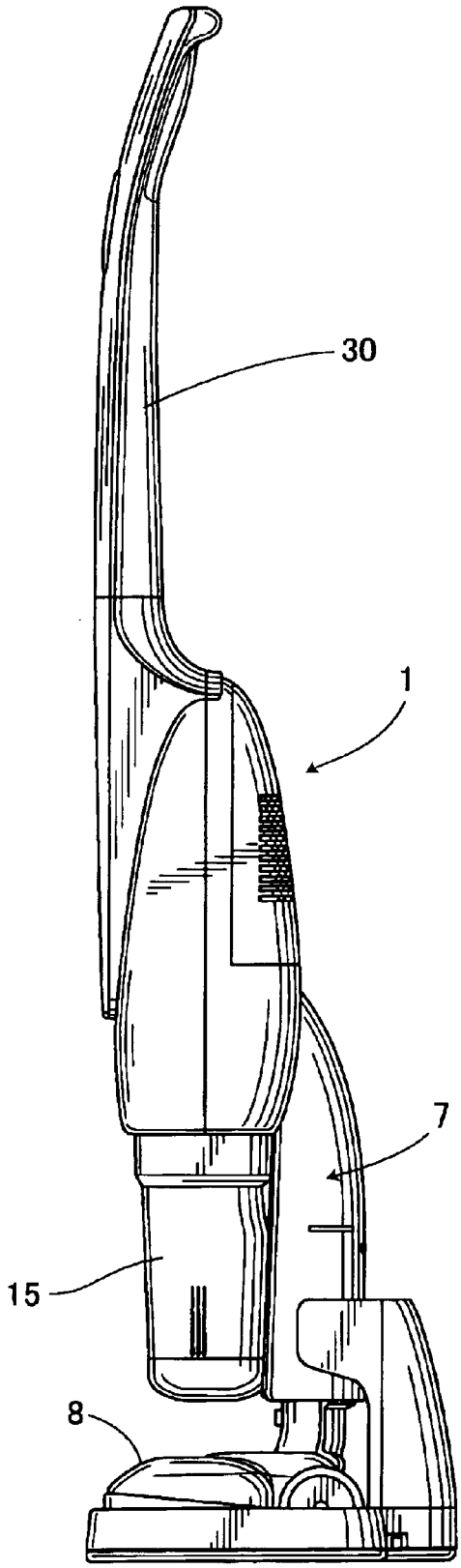
FIG. 2 is a side view of the cyclonic vacuum cleaner of FIG. 1.
Figure 3:
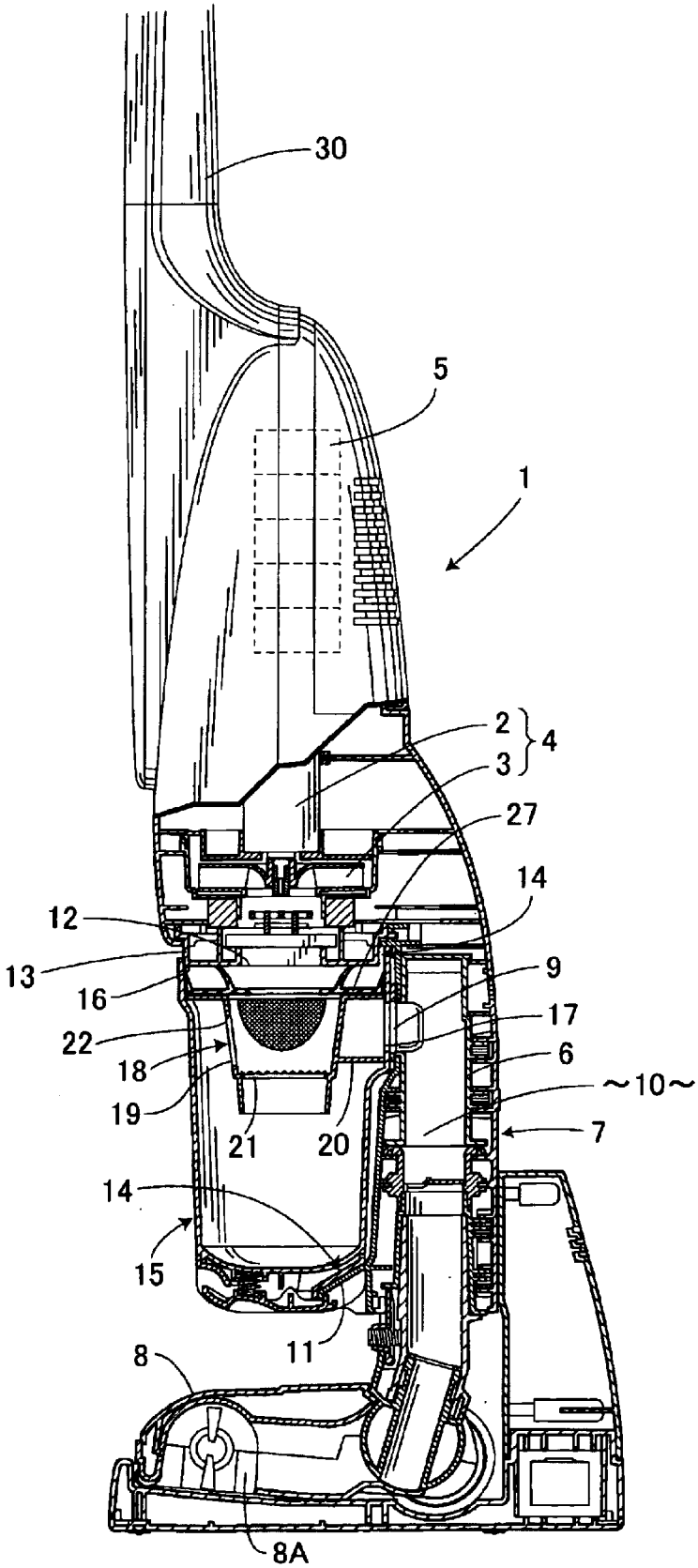
FIG. 3 is a section of a principal part of the cyclonic vacuum cleaner of FIG. 1.
Figure 4:
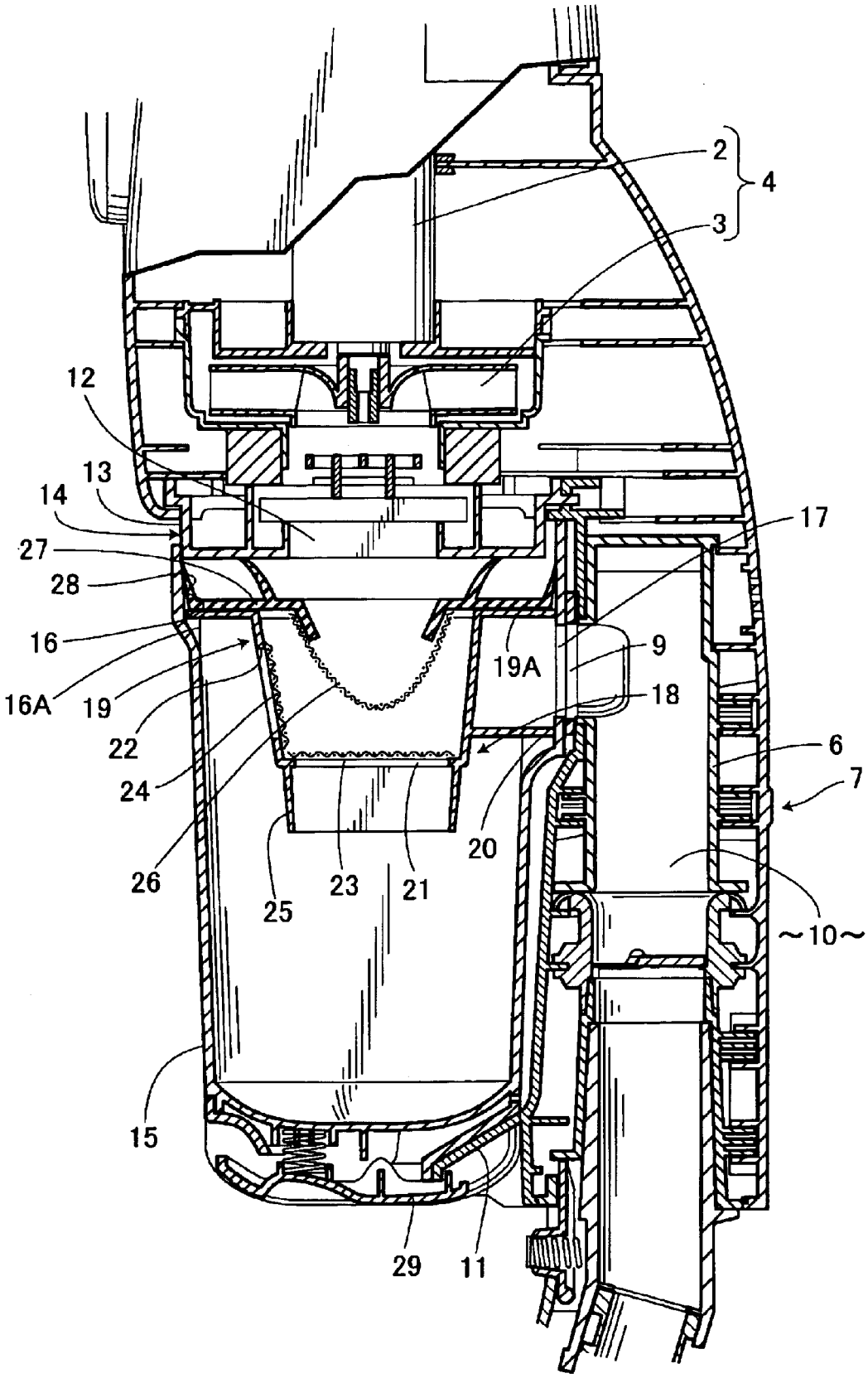
FIG. 4 is an enlarged section of the principal part thereof.
Figure 5:
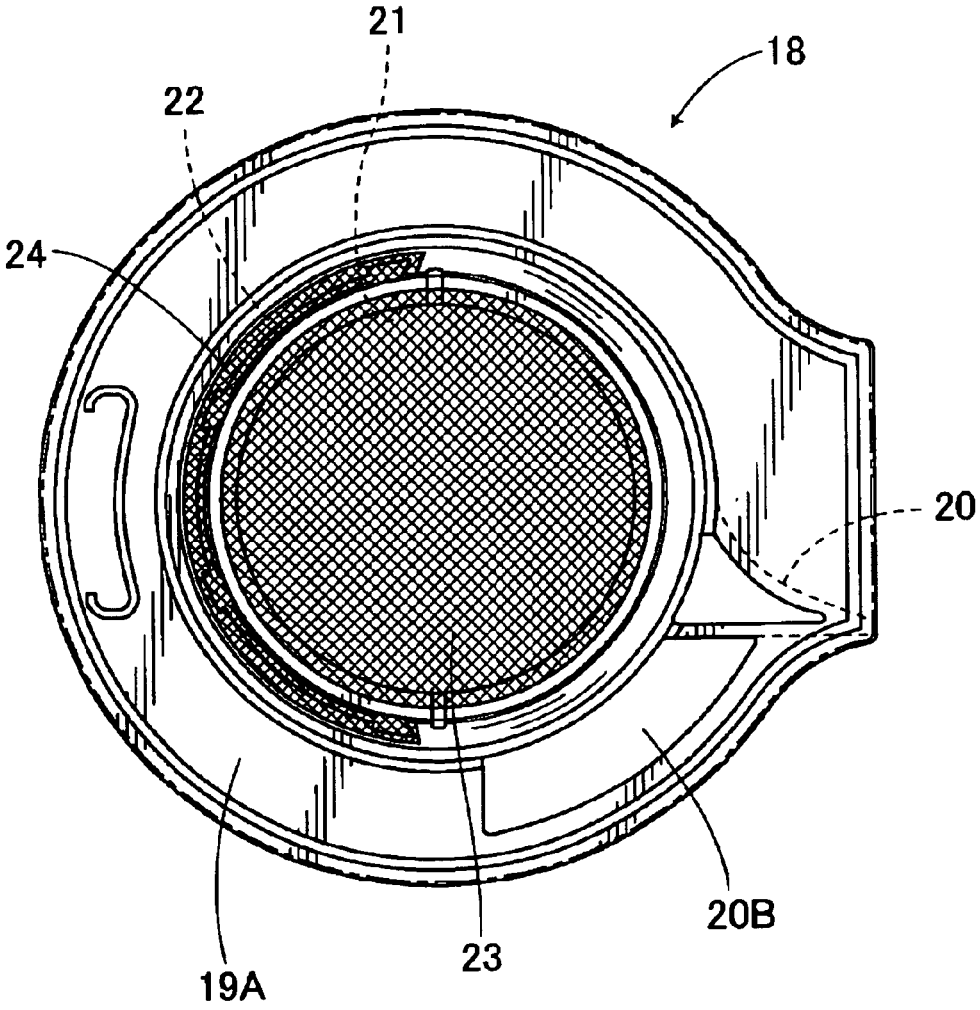
FIG. 5 is a side view of a vortex flow generating member of the cyclonic vacuum cleaner of the invention.
Figure 6:
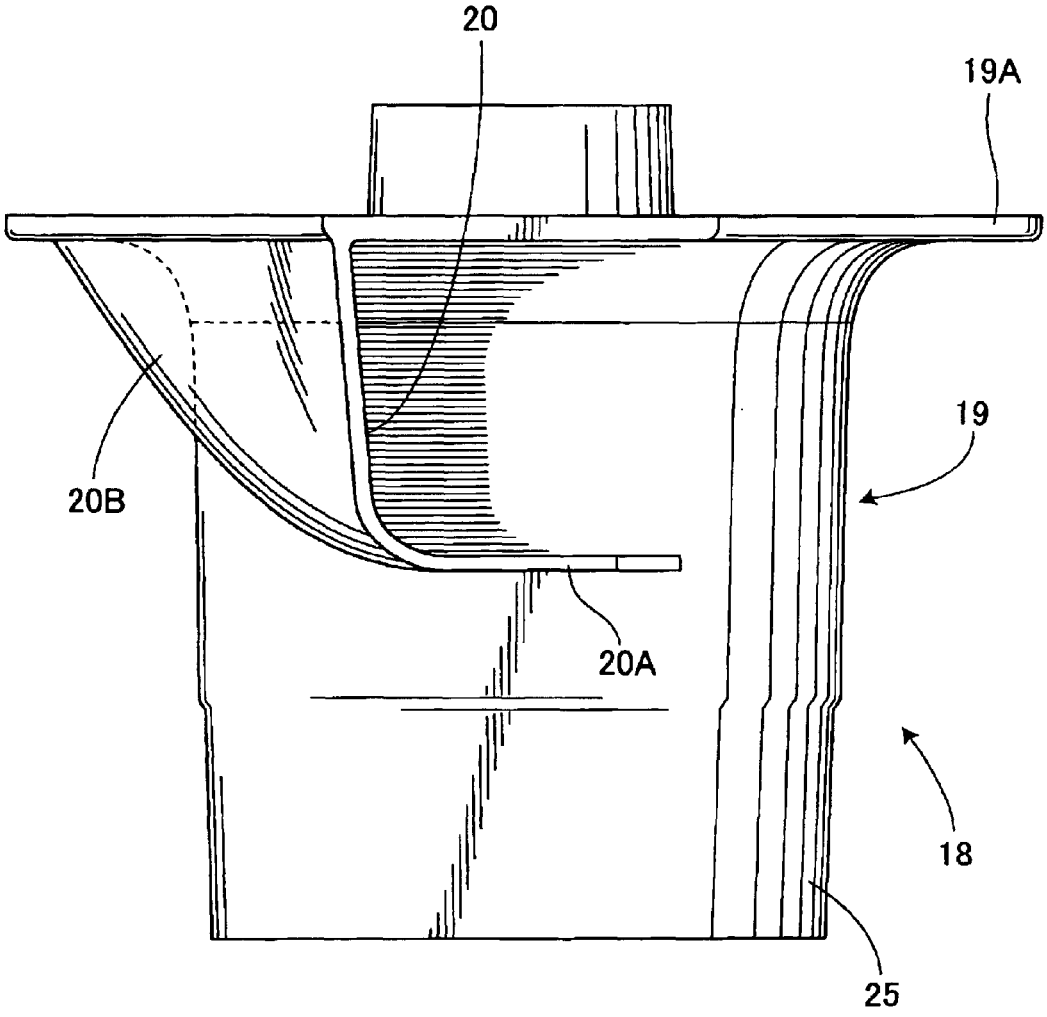
FIG. 6 is another side view of the vortex flow generating member, viewed from another direction.
Figure 7:
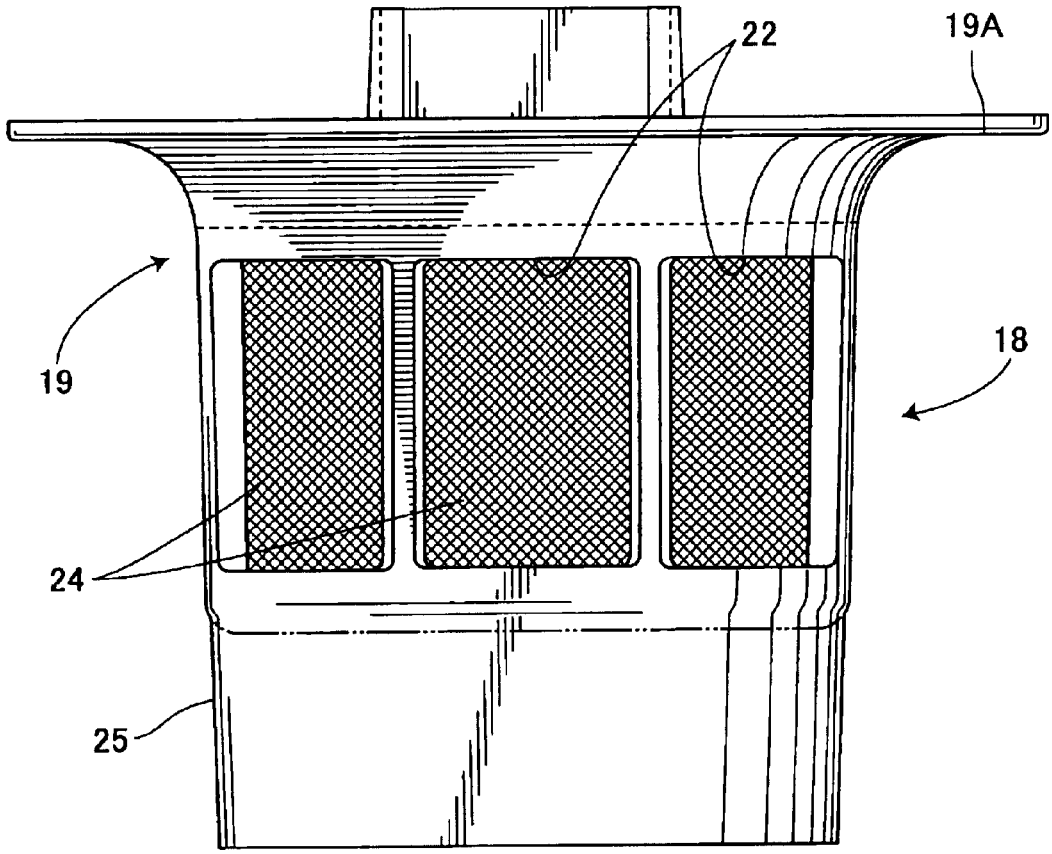
FIG. 7 is a plan view of the vortex flow generating member of the invention.
Figure 8:
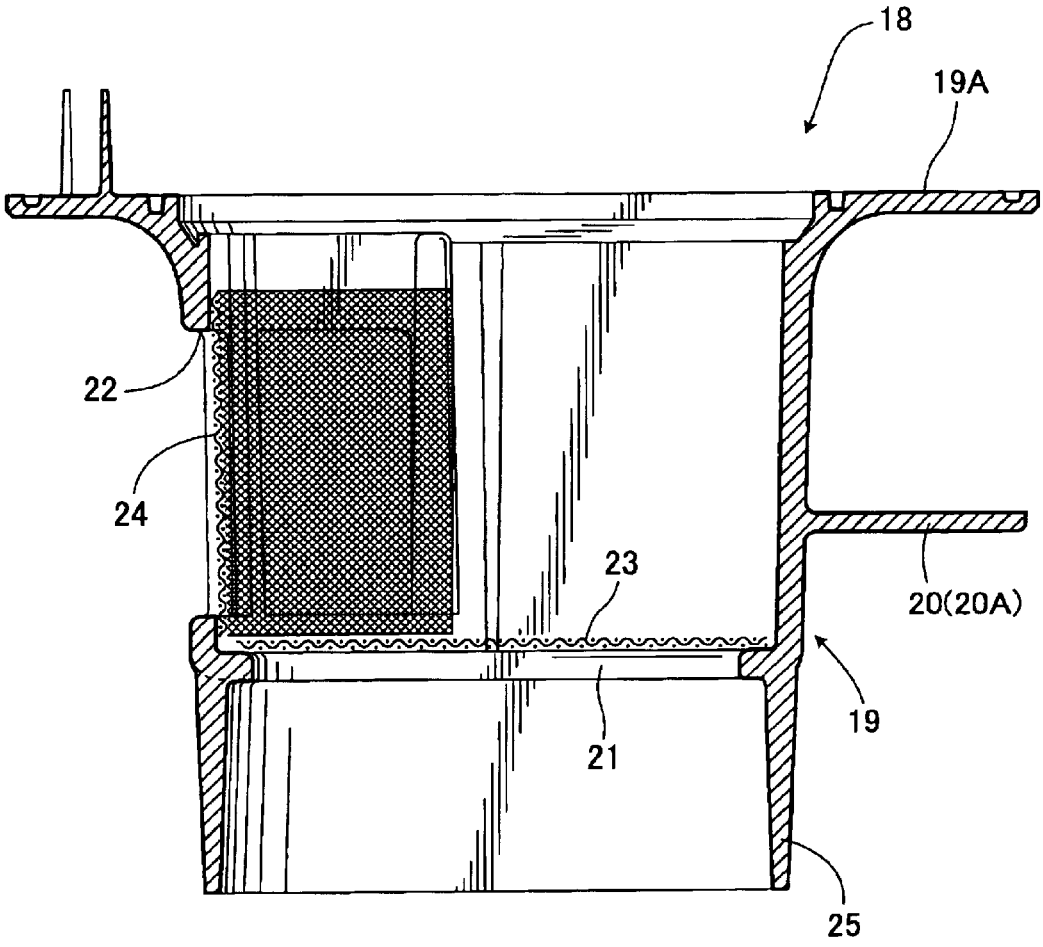
FIG. 8 is a side view of the vortex flow generating member of the invention.

Hereinafter are described preferred embodiments of the present invention with reference to FIGS. 1 through 8, in which front or back, top or bottom of the apparatus is defined, based on the posture illustrated in FIGS. 1 through 4.

In FIGS. 1 through 4, reference numeral 1 designates a cleaner body which comprises an electric motor 2 and a fan 3 mounted to the rotational shaft of the electric motor 2 provided at a bottom portion of the inside of the cleaner body 1, thereby constructing a fan unit 4. The cleaner body 1 further comprises a storage battery 5 provided at a top portion of the inside thereof.

The rear side of the cleaner body 1 is integrally formed with a projecting portion 7 which includes a vacuum tube 6 thereinside. A suction unit 8 with a suction hole 8A is removably provided at the lower end of said vacuum tube 6, while a communication hole 9 is provided at the upper end thereof, said communication hole 9 being formed at the front side of the top portion of said projecting portion 7, thereby defining a first air path 10 extending from said suction hole 8A through the vacuum tube 6 to the communication hole 9.

At the lower part of the projecting portion 7 is provided an engagement portion 11, while at the bottom part of the cleaner body 1 is provided a second air path or an intake hole 12, around which is provided a guide member 13 that is formed into a short-cylindrical shape. A dust collection container attachment portion 14 is provided at a bottom of the cleaner body 1 and in front of the projecting portion 7, said dust collection container attachment portion 14 serving to detachably attach a substantially cylindrical dust collection container 15 thereto. In the meantime, said guide member 13 is made of rubber or the like, abutting against the inner surface of an opening 16 of said dust collection container 15 to thereby retain the same, while sealing a clearance between the opening 16 and the cleaner body 1.

Said dust collection container 15 includes a side surface in the vicinity of said opening 16, said side surface being formed with a communication hole 17 which communicates with said communication hole 9. A vortex flow generating member 18 is mounted to the opening 16 of said dust collection container 15. The vortex flow generating member 18 comprises: a flange portion 19A resting on a plurality of ribs 16A formed on an inside surface of the opening 16 of said dust collection container 15; a substantially short truncated-cone-shaped base 19 formed integrally with the flange portion 19A; an airflow guide 20 formed on a side of the base 19; an inclined guide 20B provided between the flange portion 19A and a bottom 20A of the airflow guide 20; a first vent hole 21 formed at the lower end of the base 19; a second vent hole 22 formed on a side surface of the base 19; filters 23, 24 provided in the first and the second vent holes 21, 22, respectively; and a skirt portion 25 which is approximately cylinder-shaped, provided around the outer periphery of the first vent hole 21.

The vortex flow generating member 18 thus constructed is mounted to the opening 16 of the dust collection container 15 with the airflow guide 20 facing the said communication hole 17. A filter member 27 including a sack-like filter 26 is provided above the vortex flow generating member 18. The filter member 27 comprises a frame 28 made of soft resin so that it can be brought into close contact with the opening 16 of the dust collection container 15. On the other hand, a hook 29 is provided below the dust collection container 15. Thus, the opening 16 of the dust collection container 15 is fitted to the aforesaid guide 13, while the said hook 29 is allowed to engage with the aforesaid engagement portion 11, whereby the dust collection container 15 is removably attached to the dust collection container attachment portion 14. In the meantime, reference numeral 30 designates a grip which is detachable from the cleaner body 1.

Next, the action of the cyclonic vacuum cleaner of the embodiment is described.

First, the vortex flow generating member 18 is mounted to the opening 16 of the dust collection container 15, while the filter member 27 is attached from above the vortex flow generating member 18. By attaching the filter member 27 to the opening 16 of the dust collection container 15 this way, the vortex flow generating member 18 is pressed to the dust collection container 15 so that it is held in place. Thus, the opening 16 of the dust collection container 15 with the vortex flow generating member 18 and the filter member 27 attached thereto is fitted to the said guide portion 13 from below, while the hook 29 provided at the bottom part of the dust collection container 15 is allowed to engage from the front side with the engagement portion 11 provided in front of the projecting portion 7, whereby the dust collection container 15 is fixed relative to the dust collection container attachment portion 14.

When the fan unit 4 is actuated, the air inside the dust collection container 15 is allowed to pass through the first and the second vent holes 21, 22 formed in said vortex flow generating member 18 to reach the fan unit 4 via the filter member 27 and the intake hole 12. Then, the dust-laden air is sucked from the suction hole 8A, passing through the air path 10 and the communication hole 17 into the dust collection container 15. At that moment, as the frame 28 of the filter member 27 is made of soft resin, it is brought into close contact with the opening 16 of the dust collection container 15 without a gap, so that the air is prevented from entering into the dust collection container 15 via a gap between the opening 16 and the filter member 27.

The air which entered into the dust collection container 15 via the communication hole 17 is guided by the airflow guide 20 formed on the side surface of the base 19 of the vortex flow generating member 18 so that it is converted into a vortex flow, flowing along the inner surface of the dust collection container 15. If this vortex flow travels around once inside the dust collection container 15, it is then guided downwardly by the inclined guide 20B, thus allowing the vortex flow to go down helically. At that moment, the dust included in the vortex flow is pressed to the inner peripheral section of the dust collection container 15 due to a centrifugal force. When the vortex flow reaches the bottom of the dust collection container 15, the vortex flow directed downwards is then turned upwards, starting to go up in the vicinity of the center of the dust collection container 15. At the moment, as the dust included in the vortex flow is pressed to the inner periphery of the dust collection container 15 by a centrifugal force, comparatively heavy dust particles are forced to stay in the vicinity of the inner peripheral section of the dust collection container 15 when the vortex flow is allowed to flow towards the center from the inner peripheral side of the dust collection container 15, thereby separating such heavy particles from the vortex flow.

On the other hand, comparatively light or fine dust particles such as loose dust are shifted to the vicinity of the center of the dust collection container 15 with such comparatively light or fine particles being mixed in the vortex flow, and then allowed to go up within the dust collection container 15, following the ascent of the vortex flow. A majority portion of the ascending vortex flow is allowed to pass through the first vent hole 21 formed at the lower part of the vortex flow generating member 18 positioned thereabove, while a minority portion thereof is allowed to pass through the second vent hole 22 formed on the side surface of the vortex flow generating member 18. At this moment, comparatively light or fine particles included in the vortex flow are collected by the filters 23, 24 attached to the first and the second vent holes 21, 22, respectively, while finer particles that passed through these filters 23, 24 are captured by the filter 26 of the filter member 27 provided above the vortex flow generating member 18.

As discussed above, a majority of the vortex flow is allowed to pass through the first vent hole 21, and thus the filter 23 captures more dust particles than the filter 24. As a result, the filter 23 is more likely to be clogged with fine dust particles such as lint. However, as the second vent hole 22 is formed on the side surface of the vortex flow generating member 18, a substantial amount of flow is insured as the vortex flow passes through the second vent hole 22.

Further, as the short-cylinder-shaped skirt portion 25 is formed around the outer periphery of the first vent hole 22, the dust particles captured by the filter 23 are prevented from being carried on the vortex flow even though the filter 23 is clogged with the captured dust particles so that the ascending vortex flow strikes the dust captured by the filter 23 and then flows into the second vent hole 22. As a result, the filter 24 is prevented from being clogged with the dust particles.

After cleaning, the dust collection container 15 is disengaged from the engagement portion 11 by operating the hook 29, and then the lower part of the dust collection container 15 is pulled out. Thereafter, the dust collection container 15 is pulled downwardly therefrom to detach the opening 16 from the guide 13, thus removing the dust collection container 15 from its attachment portion 14. Then, the filter member 27 and the vortex flow generating member 18 are detached from the dust collection container 15, and the dust sticking to the filters 23, 24 and 26 are removed. The dust collected in the dust collection container 15 in this way is thrown away into a trashcan.

As is apparent from the foregoing, the cyclonic vacuum cleaner of the invention comprises the first vent hole 21 formed at the lower end of the base 19 of the vortex flow generating member 18, and the second vent hole 22 formed on the side surface of the base 19, whereby when the fan unit 4 is actuated, the dust-laden air sucked from the suction hole 8A passes through the air path 10 into the dust collection container 15, where it is converted into the vortex flow by the airflow guide 20 and the inclined guide 20B, so that the vortex flow thus generated is allowed to ascend within the dust collection container 15 with the dust particles being separated therefrom, passing through the first and the second vent holes 21, 22 and the intake hole 12 into the fan unit 4.

At that moment, even though fine or comparatively light particles are mixed in the vortex flow, such particles are captured by the filter 23 provided in the first vent hole 21 facing downwardly. If the filter 23 is clogged with such particles to some extent, yet the airflow inside the dust collection container 15 is allowed to pass through the second vent hole 22 formed on the side surface of the base 19 of the vortex flow generating member 18 into the intake hole 12, whereby a constant amount of airflow is insured. For this reason, it is possible to collect dust efficiently and reliably without degrading suction power.

Also, as the skirt portion 25 is provided around the first vent hole 21, the travel of the dust particles toward the second vent hole 22 can be prevented even though the dust particles captured by the filter 23 of the first vent hole 21 are carried on the vortex flow toward the second vent hole 22. Thus, the deterioration of the suction efficiency of the second vent hole 22 is suppressed, whereby it is possible to collect dusts efficiently and reliably, without lowering the suction efficiency of the vacuum cleaner body 1 as a whole.

Incidentally, the present invention should not be limited to the foregoing embodiments, but may be modified within a scope of the invention. For example, the attachment structure of the dust collection container 15, the configuration or attachment structure of the vortex flow generating member 18, guide 13, filter member 27 and etc., each relating to the fundamental structure of an vacuum cleaner, may be modified suitably. Whilst a stick-type vacuum cleaner is shown in the foregoing embodiment, the present invention may be applied to any other type of a cyclonic vacuum cleaner.

What is claimed:

1. A cyclonic vacuum cleaner which comprises:

a cleaner body with a fan unit;

a vacuum tube having a suction hole at a distal end thereof;

a dust collection container which is approximately cylinder-shaped, having a bottom;

an attachment portion for detachably attaching said dust collection container, said attachment portion being mounted to the cleaner body;

a first air path extending from said suction hole to said attachment portion in a manner capable of communicating with said dust collection container;

a second air path extending from said attachment portion to said fan unit, communicating with said dust collection container;

wherein a vortex flow generating member is provided in an opening of said dust collection container, said vortex flow generating member comprising:

a base which is formed into a shape of a short cylinder or a truncated cone;

an airflow guide provided on a side surface of said base;

a first vent hole provided at an end of said base;

a second vent hole provided at the side surface of said base; and a filter provided in each of said fist and second vent holes.

2. A cyclonic vacuum cleaner according to claim 1, wherein a skirt portion is provided around a periphery of said first vent hole.

3. A cyclonic vacuum cleaner according to claim 2, wherein said vortex flow generating member further comprises a flange portion resting on a plurality of ribs formed on an inside surface of the opening of said dust collection container; and an inclined guide provided between the flange portion and a bottom of said airflow guide.

4. A cyclonic vacuum cleaner according to claim 3, wherein a filter member including a sack-like filter is provided above said vortex flow generating member.

5. A cyclonic vacuum cleaner according to claim 4, wherein said frame is brought into close contact with the opening of said dust collection container.

6. A cyclonic vacuum cleaner according to claim 2, wherein a filter member including a sack-like filter is provided above said vortex flow generating member.

7. A cyclonic vacuum cleaner according to claim 6, wherein said filter member comprises a frame made of soft resin.

8. A cyclonic vacuum cleaner according to claim 7, wherein said frame is brought into close contact with the opening of said dust collection container.

9. A cyclonic vacuum cleaner according to claim 1, wherein said vortex flow generating member further comprises a flange portion resting on a plurality of ribs formed on an inside surface of the opening of said dust collection container; and an inclined guide provided between said flange portion and a bottom of said airflow guide.

10. A cyclonic vacuum cleaner according to claim 9, wherein a filter member including a sack-like filter is provided above said vortex flow generating member.

11. A cyclonic vacuum cleaner according to claim 10, wherein said filter member comprises a frame made of soft resin.

12. A cyclonic vacuum cleaner according to claim 1, wherein a filter member including a sack-like filter is provided above said vortex flow generating member.

13. A cyclonic vacuum cleaner according to claim 12, wherein said filter member comprises a frame made of soft resin.

14. A cyclonic vacuum cleaner according to claim 13, wherein said frame is brought into close contact with the opening of said dust collection container.

* * * * *